United States Patent [19]

Pilati

[11] 4,215,865

[45] Aug. 5, 1980

[54] GOLF GAME

[76] Inventor: Oliver H. Pilati, 445 S. Worchester Way, Aurora, Colo. 80012

[21] Appl. No.: 932,526

[22] Filed: Aug. 10, 1978

[51] Int. Cl.[2] ..... A63B 69/36

[52] U.S. Cl. ..... 273/176 FA; 273/182 A

[58] Field of Search ..... 273/182 R, 182 A, 179 R, 273/181 H, 176 FA, 176 K

[56] References Cited

U.S. PATENT DOCUMENTS

| | | | |
|---|---|---|---|
| 1,584,093 | 5/1926 | Harris | 273/182 R |
| 1,899,860 | 2/1933 | Flower | 273/182 A X |
| 3,037,776 | 6/1962 | Younce | 273/182 A |
| 3,184,239 | 5/1965 | Heuser | 273/176 FA |
| 3,784,207 | 1/1974 | Gentiluomo | 273/181 H X |

*Primary Examiner*—George J. Marlo

*Attorney, Agent, or Firm*—Ancel W. Lewis, Jr.

[57] ABSTRACT

A golf game for use in practicing the golf strokes of driving, approach shots, putting and the like, requiring only a limited space. The game includes a base simulating a fairway that is preferably enclosed by at least a top and opposed side walls to contain flying golf balls, a target area at one end of the fairway and a teeing area opposite the target area. The target area is constructed for stopping balls that strike or miss the targets and has photoelectric cells for sensing the balls when they strike a target. A putting hole is provided in the fairway opposite the teeing area. A collection arrangement collects the balls that are shot at and strike or miss the targets and a ball sweeping assembly normally disposed out of the way of the teeing area and fairway is used to selectively sweep the fairway for the return of the balls for reuse. The ball sweeping assembly includes a sweeping board pivotally mounted on a support frame, a bias spring holding the board in the sweeping position together with a drive motor and a drive train for selectively moving the support frame and board back and forth relative to the fairway.

16 Claims, 15 Drawing Figures

GOLF GAME

FIELD OF THE INVENTION

This invention relates to a novel and improved golf game for practicing various golf strokes.

BACKGROUND OF THE INVENTION

There is a widespread interest in learning and improving one's skills in the game of golf. Some attempts have heretofore been made to provide apparatus in a relatively small area in which a player may practice various golf strokes such as driving, approach shots and putting by hitting the ball from a teeing area against a backstop or target area or into a simulated golf cup. U.S. Pat. Nos. 1,258,241, 1,899,860, 2,054,079, 2,701,140, 3,189,239, 3,260,527, 3,366,387, 3,567,233, 3,706,452, and 3,720,413 disclose known prior apparatus for this purpose.

Accordingly, it is an object of the present invention to provide a novel and improved golf game that allows a player to practice different golf strokes including driving, approach shots, and putting within a limited space.

Another object of the present invention is to provide a golf game with a target area, a putting hole, and a system of scoring that enables a player to evaluate his shots and overall proficiency.

Still another object of this invention is to provide a target in which the balls are stopped from being reflected by the target back to the player.

A further object of the present invention is to provide a golf game characterized by a highly effective golf ball sweeping and return apparatus.

SUMMARY OF THE INVENTION

Generally stated, the golf game of the present invention comprises a relatively small building having contained therein a teeing area, a fairway, a putting hole, and a target area with a plurality of targets. Balls may be either putted from the teeing area over the fairway into the putting hole or driven from the teeing area into the targets. Means are provided for automatically scoring a player's shots, for sweeping dead balls from the fairway, and for automatically returning the balls to the player at the teeing area.

The target includes a shock absorbing curtain assembly that stops balls which do not hit the target and delivers them to a collecting trough. A target box is located behind an opening in a shock absorbing curtain and has an inlet opening for receiving balls and an outlet opening of smaller cross section than the inlet opening through which the balls are discharged. For scoring the shots each target includes a sensing device connected to a scoreboard that registers an assigned score, depending on the location of the target, for the balls that pass through a target. A sensing switch in the putting hole which is also connected to the scoreboard registers a score for balls that pass through the putting hole.

A ball return means includes a collection trough that collects balls at the target area for return to the teeing area. Conduits on either side of the building extend from the collection trough to the teeing area and automatically return the balls to the player by gravity. Dead balls on the fairway are swept into the collection trough after each game by an electrically powered sweeping board that can be selectively operated to sweep the fairway.

Other objects, advantages and capabilities of the present invention will become more apparent as the description proceeds, taken in conjunction with the accompanying drawings in which like parts have similar reference numerals and in which.

DESCRIPTION OF THE PREFERRED EMBODIMENTS

Figures 1, 2, 3, 4:
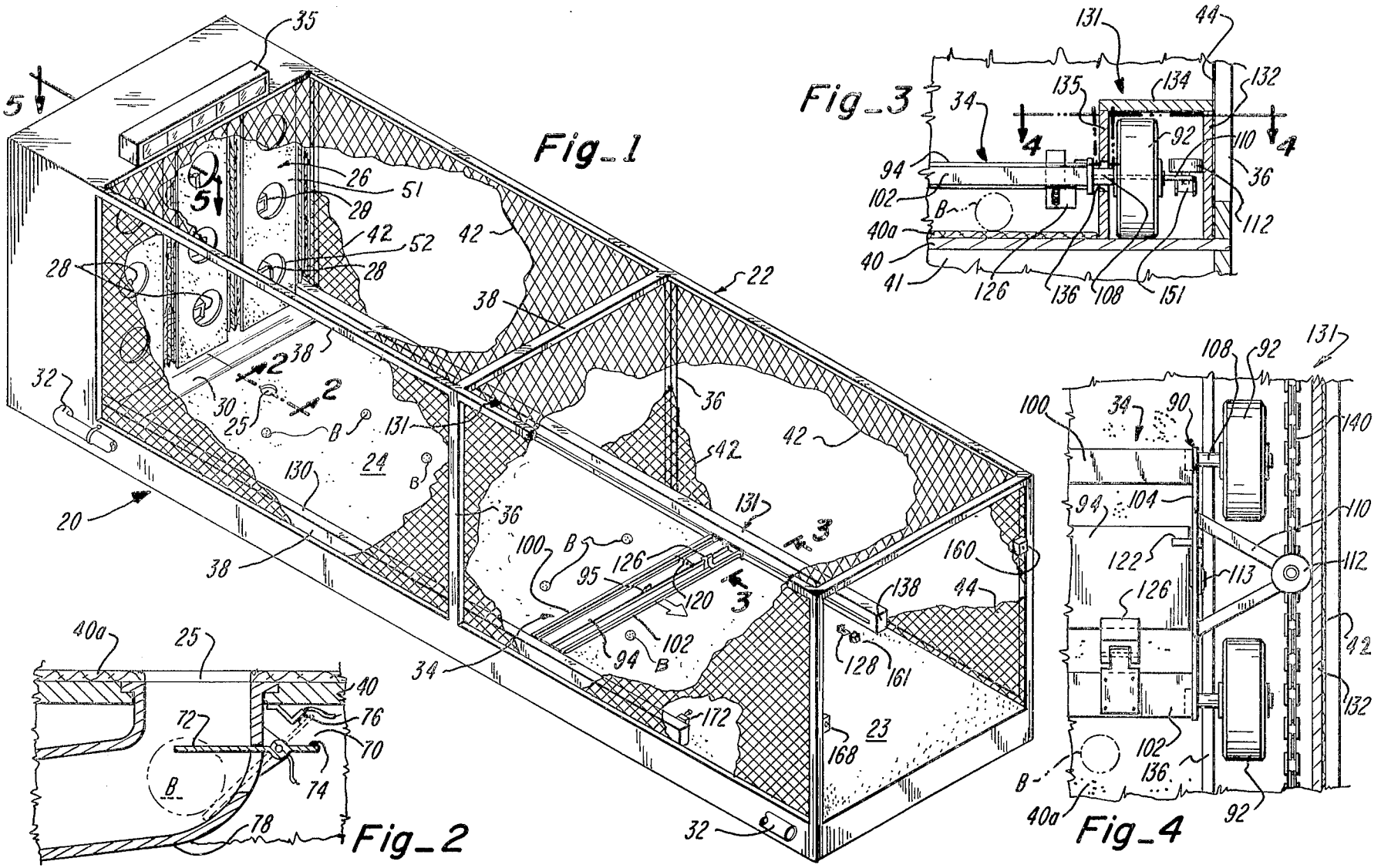
FIG. 1 is a perspective view of a golf game in accordance with the present invention with a portion of the netting broken away to show interior parts.
FIG. 2 is a cross section along section line 2—2 of FIG. 1 through the putting hole of the golf game.
FIG. 3 is a cross-sectional view taken along lines 3—3 of FIG. 1.
FIG. 4 is a cross-sectional view taken along lines 4—4 of FIG. 3.

Referring now to FIGS. 1 and 2, the golf game shown and designated 20, generally stated, includes a box-like structure or building 22 having a teeing area 23 at one end, a fairway 24 extending along the bottom, a putting hole 25 and a target area 26 opposite the teeing area. There are a plurality of target units 28 mounted in the target area 26, a ball collection trough 30 located beneath the target units 28 and coupled to a pair of ball return conduits 32 mounted at the sides and along the floor of the building 22 and a ball sweeper or sweeping assembly 34 for selectively sweeping dead balls from the fairway 24. A scoreboard 35 is shown on top of the building in the target area for indicating the proficiency of the player.

Building

The building 22 shown includes a framework of spaced vertical support members 36 and spaced horizontal support members 38, which may be wooden beams or the like, attached at right angles to one another, and a floor 40 which is elevated above ground level to form a lower compartment 41. Netting material 42 that is impervious to golf balls is attached to the vertical members 36 and horizontal members 38 of the framework on the sides and top of the building to form opposed side walls and a top wall thereof. The building 22 is thus enclosed on both sides and the top by the netting and is enclosed by the target area at one end and is shown open on one end 44 opposite the target area for admitting players to the teeing area 23. A door closure may be used to close off end 44 along with, for example, a coin-operated lock for commercial installations. The floor 40 of the building is shown covered with a material such as indoor-outdoor carpeting indicated at 40*a* to simulate the grassy surface of a golf course. The overall dimensions of the building 22 may vary to accommodate different space arrangements. The overall dimensions of a building found suitable for the present invention are approximately 8'×8'×30' for the width, height and length, respectively.

Target Area

The target area 26 is constructed with top, side and end walls of an imperforate or solid construction and houses the target units 28 and the ball sweeper 34 in the at-rest position. A shock absorbing curtain assembly 50 is located at the front of the target area facing the teeing area 23 and functions to absorb the impact of balls which are shot at the target area but do not hit the target units 28. The curtain assembly 50 generally is fixedly secured along its upper end to the top wall of the building at the target area and freely hangs or depends down to just above the ball collection trough 30 to deflect balls into the collection trough 30.

Figures 5, 6, 7, 8, 9, 10, 11, 12, 13, 16:
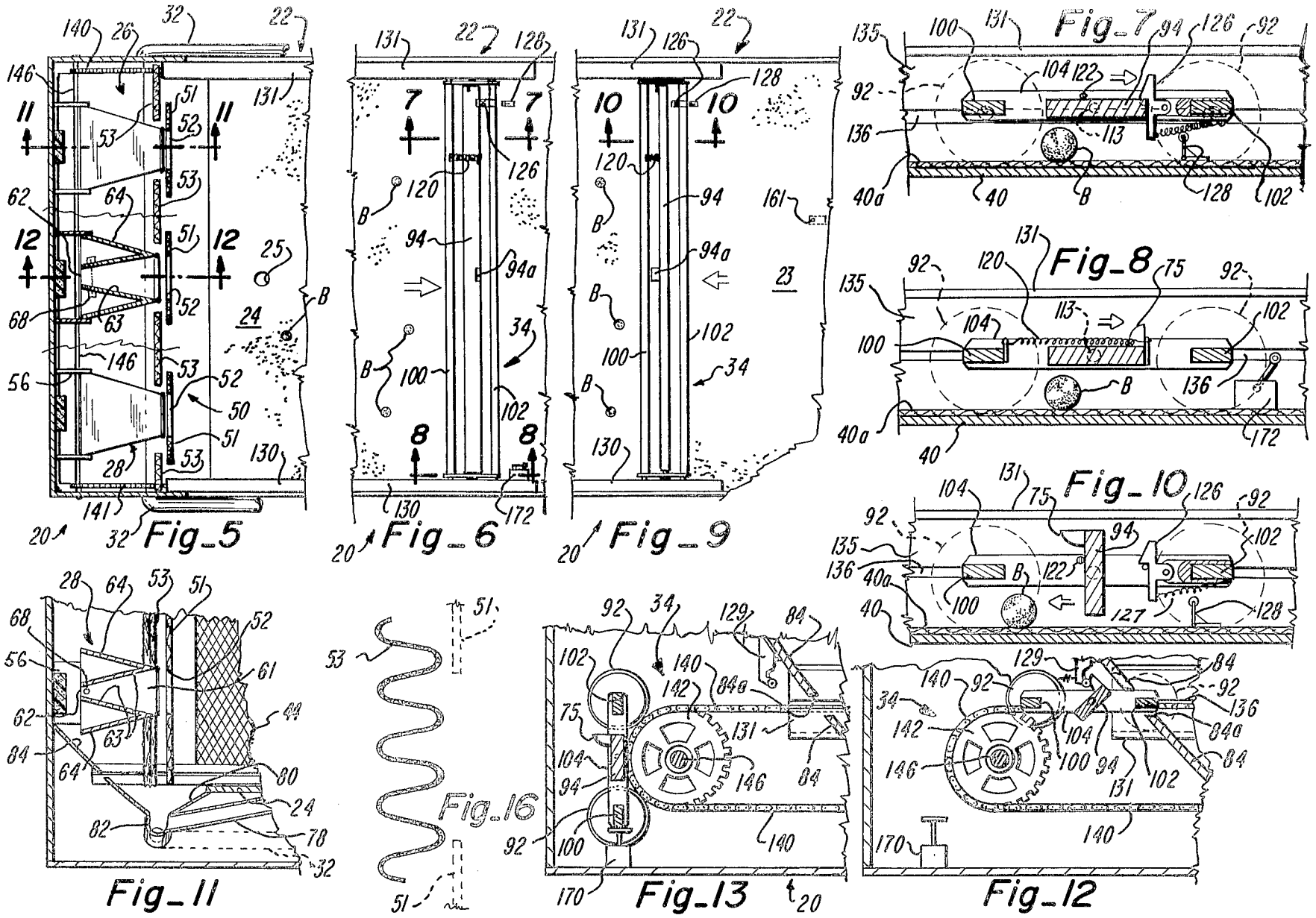
FIG. 5 is a cross-sectional view taken along lines 5—5 of FIG. 1.
FIG. 6 is a plan view above the ball sweeping assembly in the teeing area showing the position of the sweeping board in a latched, horizontal position before engaging the unlatching cam.
FIG. 7 is a cross-sectional view taken along lines 7—7 of FIG. 6.
FIG. 8 is a cross-sectional view taken along lines 8—8 of FIG. 6.
FIG. 9 is a plan view above the ball sweeping assembly in the teeing area showing the position of the sweeping board in an unlatched, sweeping position.
FIG. 10 is a cross-sectional view taken along lines 10—10 of FIG. 9.
FIG. 11 is a cross-sectional view taken along lines 11—11 of FIG. 5.
FIG. 12 is a cross-sectional view taken along lines 12—12 of FIG. 5.
FIG. 13 is a cross-sectional view taken along the same position as FIG. 12 with the sweeping assembly in the at-rest position.

The curtain assembly 50 shown is made up of three laterally spaced strips of material 51, preferably made of a fabric such as ordinary floor carpeting, that are affixed at their upper ends to the top of the building and are spaced along the bottom from the collector trough 30. Each strip has three cut-out openings 52 leading to an associated target unit 28. As best seen in FIG. 5, behind and between the adjacent edges of strips 51 and between the outer strips 51 and side walls of the building there is a strip 53 of material to stop the balls that pass between the strips 51. A highly effective absorbing arrangement for strip 53 has been found to be a fabric such as fish netting supported in a depending manner and bunched together with sinuous folds, as is illustrated in FIG. 16, much like that of a window curtain that is drawn back to the side of a window.

Alternatively, a single or unitary curtain of this type may be provided as the shock absorbing curtain across the front of the target area with appropriate openings 52 to permit the ball to pass through the target units. The shock absorbing curtain assembly 50 may be fabricated from a strong absorbing material such as heavy cloth, canvas, fish netting or the like.

In the arrangement shown there are nine target units 28 of a similar construction mounted in three rows located directly behind an associated cut-out opening 52. Referring now to FIGS. 5 and 11, each target unit 28 is attached by braces 56 to the rear wall of the building. As shown in FIG. 11, each target unit is in the form of a conduit having a through passageway with an inlet opening 61 for receiving balls and an outlet opening 62 for discharging the balls. The inlet opening 61 has a larger cross-sectional area than the outlet opening 62.

The inner surfaces of the conduit are provided by four inside walls 63 along the top, bottom and opposed sides that are inclined to form a rearwardly converging passageway. The outer surfaces of the target box are defined by four outside walls 64 along the top, bottom and opposed sides that are rearwardly diverging to deflect the ball in a direction other than back toward the curtain 50.

As will hereinafter be explained, the passage of the ball through a target unit is sensed and a score is automatically registered for balls that pass through the outlet opening 62. The inner walls 63 may be padded with a shock absorbing material such as carpeting to absorb the impact of the balls that hit the targets.

For scoring the balls each target has a sensing device 68 such as a photoelectric cell mounted adjacent the outlet opening 66 which is connected to the scoreboard 35. Each target is assigned a certain point value which may be dependent on the location of the target. When the sensing device 68 is actuated by a ball passing through the target unit, a circuit is completed that automatically registers the assigned score for the target on the scoreboard 35.

In addition, as shown in FIGS. 1 and 2, the putting hole 25 has an electric sensing switch 70 connected to the scoreboard 35 for scoring shots that pass through the putting hole 25. Electric sensing switch 70 has a pivotally mounted arm 72 within the putting hole that may be pivoted by balls passing through the hole to the fathom position shown in FIG. 3. In one position shown in dashed lines a contact 74 on pivot arm 72 makes contact with a stationary contact 76 mounted to the outside of the putting hole to complete an electrical connection for registering a score on the scoreboard 35. A conduit 78 under the floor 40 carries the ball to one of the ball return conduits 32.

Trough

Referring now to FIG. 11, the ball collection trough 30 is shown. The ball collection trough 30 is located below the target area and comprises a front sloping surface 80 adjacent the fairway 24 that slopes rearwardly and downwardly away from the fairway, a sloping center conduit 82 in communication with ball return conduits 32 to the teeing area at either side of the building, and a curved rear sloping surface 84 that slopes forwardly and downwardly toward the fairway. The front surface 80 and rear surface 84 and the center conduit 82 of the collection trough are elevated in the center and slope downward toward the sides of the building. This arrangement is such that all of the balls that hit the target area, including balls which hit the shock absorbing curtain assembly 50 and balls that pass through the target units 28, collect in center conduit 82 where they are directed into the ball return conduits 32 for return to the teeing area.

The ball return conduits 32 extend along the length of the building on either side of the building and slope downward from the collection trough 30 to the teeing area 23. The balls thus roll by gravity through the conduits back to the teeing area. Alternatively, a collection bucket (not shown) may be placed on either side of the center conduit 82 of the collection trough to collect the balls for return by hand to the teeing area.

Ball Sweeper

Generally stated, the ball sweeper 34 comprises a sweeping carriage movable relative to the fairway which includes a generally rectangular support frame 90 mounted at the corners on four wheels 92, a sweeping board 94 pivotally mounted on the support frame 90, and a drive 96 coupled to the support frame for moving the support frame and ball sweeper 34 along the fair-way 24. The drive is illustrated schematically in FIGS. 14 and 15.

The support frame 90 includes two parallel spaced, elongated support members 100 and 102 extending laterally of the fairway joined at the ends by two parallel spaced end members 104 and 106. Each support member has a wheel 92 on each end freely rotatably mounted to mounting studs 108. Two generally triangularly shaped guide support brackets 110 are attached to the end members 104 and 106, respectively. A freely rotatable guide roller 112 is mounted on each end of the brackets 110.

The sweeping board 94 is pivotally mounted to the support frame 90 at its ends by two pivot pins 113 pivotally attached to the support frame. As shown in FIGS. 7, 8 and 10, the sweeping board 94 has a generally rectangular cross section and may be pivoted about the pivot pins 113 between the generally horizontal position shown in FIG. 8 and the generally vertical position shown in FIG. 10. In its vertical position the sweeping board 94 will contact and sweep golf balls designated B on the fairway. In its horizontal position, as shown in FIG. 8, the sweeping board 94 will pass over the golf balls on the fairway.

A torsion spring 120 is attached at one end to support member 100 and at the other end to a corner of the board 94 opposite support 100 which tends to bias the sweeper 94 in its vertical position against a stop 122 attached to each of the end members of frame 90. A spring-loaded latch 126 pivotally attached to the support member 102 of the support frame 90 by a pivot pin 91 retains the board 94 in the horizontal position shown in FIGS. 7 and 8 against the bias of torsion spring 120. The latch 126 is biased by an extension spring 127 connected between the lower end of latch 26 and member 102 to contact the board 94.

Figure 14:
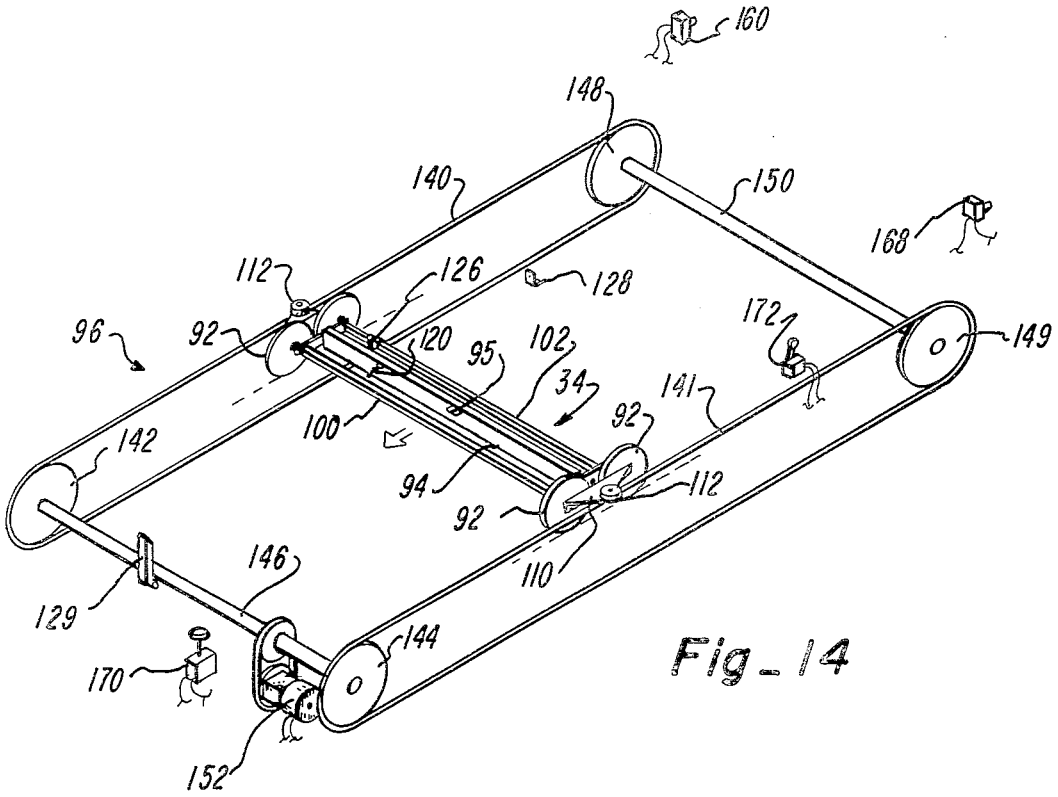
FIG. 14 is a perspective view of a schematic illustration of the drive of the ball sweeping assembly.

An unlatching cam roller 128 is attached to the floor 40 of the building 20 near the teeing area 23 and contacts the lower end of latch 126 as it passes thereover for unlatching the sweeping board 94 and releasing it to the vertical position shown in FIG. 10. In the target area a latching cam roller 129 is pivoted for latching the sweeping board 94 into its horizontal latched position from its vertical position after the fairway has been swept. More specifically, the latching cam roller 129, as best seen in FIGS. 12, 13 and 14, is disposed along a centerline of the fairway above the collection trough and engages an upstanding tip on the board 94 before the board reaches back wall 84 of the trough. The trough 84 has a hole **84*a*** of a size to permit the board to pass therethrough but inhibit balls from passing therethrough.

Referring now to FIGS. 1, 3 and 4, a pair of parallel spaced guide tracks 130 and 131 are provided along each side of the floor 40 of the building 22 for guiding the movement of the sweeping assembly 34 along the fairway. The guide tracks 130 and 131 have a generally box-like shape and extend from the teeing area 23 to the target area 26. Referring to guide track 131, this is shown to have an outer side wall 132, a top wall 134, and an inner side wall 135 with a slot 136 through which the shaft of the wheel 92 extends, with the wheel riding on the floor 40, for enclosing and guiding the wheels 92 of the sweeping board assembly which ride over the floor 40 of the building. The ends of the guide tracks are closed as indicated by end wall 138. In addition, as shown in FIGS. 3 and 4, the guide rollers 112 on each of the sweeper board assembly tracks ride along the inside of outer side wall 132.

Drive

The drive as shown in FIG. 14 for moving the ball sweeping assembly 34 includes a reversible motor 152 located at the target end under the floor 40 on a suitable base having a drive train coupled between the output shaft of the reversible motor and both ends of the support frame of the ball sweeping assembly. The drive train includes a common drive shaft 146 that extends under and laterally of the floor in the target area, is coupled to the output shaft of the motor by pulleys and a chain in a conventional manner, and has parallel spaced, axially alined drive sprockets 142 and 144 affixed to the opposite ends of the drive shaft 146.

There is further provided an idler sprocket 148 alined with drive sprocket 142 along the floor and in turn an idler sprocket 149 alined with drive sprocket 144 along the floor. Idler sprockets 148 and 149 are arranged parallel with and axially spaced from one another and are mounted at the ends of a common shaft 150. An endless drive chain 140 is mounted on sprockets 142 and 148 and an endless drive chain 141 is mounted on drive sprocket 144 and idler sprocket 149. The idler sprockets 148 and 149 are located in the teeing area.

Each of the drive chains 140 and 141 has one chain link designated 151. These chain links are opposite one another laterally of the fairway and affixed to the outer end of the carriage bracket 110 as shown in FIG. 3 so that, as shaft 146 is rotated, drive sprockets 142 and 144 drive the associated chains 140 and 141 in a synchronized manner to move the sweeping board 94 back and forth along the fairway according to the rotation of the shaft of motor 152.

Control Circuit

Figure 15:
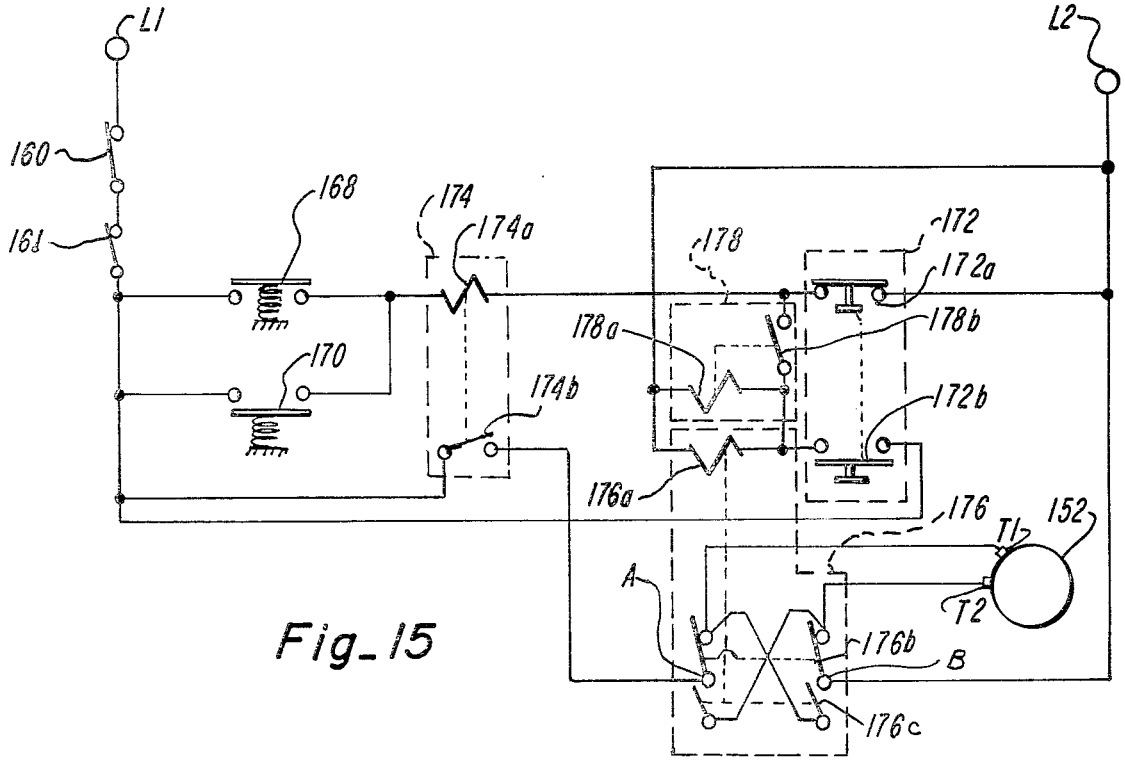
FIG. 15 is a schematic diagram of an electric control circuit of the ball sweeping assembly.

A control circuit which enables the player to selectively control the operation of the reversible electric drive motor 152 is shown schematically in FIG. 15. An electric emergency switch 160, preferably located in the teeing area for actuation by the operator to shut down the operation at any time, is shown connected in power line L1 of power lines L1 and L2. There is further shown a plunger-actuated electric safety switch 161 connected in power line L1 located in the floor in front of unlatching cam 128 to be tripped in case the reversing switch 172 fails to stop the movement of the ball sweeping assembly 34.

The power to the electric motor 152 is primarily controlled by a series circuit connected across lines L1 and L2 including a normally-open push button start switch 168, the motor run relay coil **174*a* of the motor run relay 174, and a set of contacts 172*a* of the plunger-actuated reversing switch 172 so that, when contacts 172*a* and start switch 168 are closed, the coil 174*a* is energized and its associated contacts 174*b* close. A set of contacts of the plunger-actuated switch 170 is connected in parallel with start switch 168 so that either may directly control the energization of the motor relay coil 174*a***.

The motor run relay coil **174*a* then controls current in another series circuit across lines L1 and L2 including the contacts 174*b* of the motor run relay 174 and the power terminals A and B of reversing relay 176 having two sets of contacts 176*b* and two sets of contacts 176*c* which in turn connect to terminals T1 and T2 of the reversible motor 152**. When the two sets of contacts 176*b* are closed, the two sets of contacts 172*c* are open and the motor 152 runs in one direction, and when the two sets of contacts 172*c* close, the two sets of contacts 176*b* open, the current direction is reversed, and the motor runs in the opposite direction.

There is further provided another series circuit across lines L1 and L2 including the coil 178*a* of the timing relay 178 and the other set of contacts 172*b* of reversing switch 172. Contacts 172*a* and 172*b* are mechanically interconnected so that when one is open the other is closed. Timing relay 178 has a set of contacts 178*b* that are connected at a point common to the motor relay coil 174*a* and contacts 172*a* and to the point common to the timing relay coil 178*a* and the other set of contacts 172*b*. Thus when contacts 172*a* open current is maintained in the motor run relay coil 174*a* via contacts 178*b* and contacts 172*b*, and when contacts 172*b* open current is maintained to the timing coil 178*a* independently of either set of the contacts of switch 172 via contacts 178*b* and coil 178*a* to line L2. Reversing relay coil 176*a* is connected in parallel with timing coil 178*a* to be energized when coil 176*a* is energized.

The contacts of the circuit components are shown in a position with the sweeping assembly 34 in an at-rest location in the target area, as shown in FIG. 13, with the contacts of switch 170 held open by the sweeping assembly 34. In a full sequence of operation for the control circuit shown in FIG. 11, the contacts of switch 170 are held open by the sweeping assembly 34 contacting the plunger. Start button 168 is depressed, the relay coil 174*a* is energized via contacts 172*a*, and, with one of the two sets of contacts 174*b* in the reversing relay closed, the motor 152 will run in a direction to move the sweeping assembly 34 toward the teeing area, and this continues until the set of contacts 172*a* are opened as a result of the sweeping assembly 34 engaging the plunger of switch 172 to open contacts 172*a* and close contacts 172*b* to remove current from coil 174*a* and the motor stops.

The timing coil 178*a* and reversing coil 176*a* are now energized to open the two sets of contacts 176*b* and close the two sets of contacts 176*c* to set the motor for running in the opposite direction. The motor does not run in the reverse direction, however, until the time delay of relay 178 has elapsed and the contact 178*b* closes, completing the power circuit to the motor relay coil 176 via contacts 178*b* and coil 178*a* back to line L2, and the motor then runs in the reverse direction moving the sweeping board toward the target area.

As soon as the sweeping assembly 34 moves away from switch 172, the contacts of switch 172 are mechanically reset with the contacts 172*a* and 172*b* in the position shown. The motor continues to run, however, in a direction to drive the sweeping board toward the target area until it engages the plunger of switch 170, opening its contacts, at which time the motor relay coil 174*a* is de-energized and power to the motor is removed as it stops in the out-of-the-way at-rest position in the target area shown in FIG. 13. The circuit is then ready for the pushing of the start button and the cycle is repeated.

In the play of the game a player will stand at the teeing area 23 of the building and either drive balls at the targets 28 or putt balls over the fairway into the putting hole 25. Since different scoring values can be assigned each target, a player may aim for those targets which provide the highest scores. A player's score will thus reflect his shooting proficiency. Balls that hit the target units or shock absorbing curtain assembly 50 collect in the collection trough 30 and are returned to the player at the teeing area for the next game. After a game has been completed, dead balls on the fairway may be swept off the fairway into the collection trough by the operation of the sweeping board assembly.

Although the present invention has been described with a certain degree of particularity, it is understood that the present disclosure has been made by way of example and that changes in details of structure may be made without departing from the spirit thereof.

What is claimed is:

1. A golf game comprising:

a base providing a fairway, a target area at one end of the fairway and a teeing area at the other end of the fairway opposite the target area;

a target arrangement in the target area including targets and means for stopping balls that strike or miss the targets for preventing the balls from being deflected back from the target area to the teeing area;

sensing means for sensing balls that strike a target;

means in the target area for collecting balls that are shot at the target area for return to the teeing area; and means for sweeping balls from said fairway into said ball collecting means, said sweeping means including:

a support frame;

a sweeper mounted to said support frame and movable from a first position wherein balls on the fairway are not contacted by movement of said sweeper to a second position wherein balls on the fairway are contacted by movement of said sweeper;

wheels mounted to said support frame for supporting said support frame for movement along said fairway;

a guide track for guiding said wheels;

a drive assembly for driving said support frame along said fairway; and means for positioning said sweeper in its first position when said sweeper is moved from the target area to the teeing area and in the second position when said sweeper is moved from the teeing area to the target area whereby balls are contacted by said sweeper and pushed into said ball collecting means.

2. A golf game as defined in claim 1 including a putting hole with a sensing device adapted for connection to a scoreboard for sensing balls that pass through said putting hole.

3. A golf game as defined in claim 1 wherein said fairway is enclosed at least in part along the sides and above the fairway to contain flying balls.

4. A golf game as defined in claim 3 wherein the enclosure for said fairway is provided by a support means supporting a netting impervious to golf balls.

5. A golf game as defined in claim 1 wherein said drive assembly includes a reversible electric motor, said motor being automatically controlled by a control circuit operable by the player, said control circuit including a first limit switch in the target area to stop the motor when the sweeper is at an out-of-the-way position in the target area and a second limit switch in the teeing area to reverse the motor after said sweeper is set in a sweeping position.

6. A golf game as set forth in claim 5 wherein said control circuit includes a start switch to start the motor, a safety switch to stop the motor if the sweeper does not reverse, and an emergency switch to shut down the movement of the sweeper at any time.

7. A golf game as set forth in claim 5 including a time delay relay to enable the motor to stop prior to turning in a reverse direction.

8. A golf game as set forth in claim 1 wherein said sweeper includes an elongated sweeping board, a spring to bias the board upright to a sweeping position, and a latch to hold the sweeping board in a horizontal non-sweeping position.

9. A golf game as set forth in claim 8 including an unlatching cam in the teeing area for engaging the latch and a latching cam in the target area for enabling said latch to latch said sweeping board in the horizontal position.

10. A golf game as set forth in claim 9 wherein said sweeping board passes through said collecting means to an at-rest position in the target area during the playing of the game.

11. A golf game as set forth in claim 1 wherein said drive assembly includes a motor and a drive train, said drive train including a shaft rotated by said motor, drive sprockets mounted at opposite ends of said drive shaft, an idler sprocket alined with each drive sprocket, and a drive chain extending around each drive sprocket and an alined idler sprocket, the ends of the sweeper being coupled to the drive chains.

12. A golf game as set forth in claim 1 wherein each of said target units has rearwardly converging wall surfaces to stop the balls that strike a target.

13. A golf game comprising:

a substantially enclosed building having a floor elevated above ground level providing a fairway, a target area at one end of the fairway, and a teeing area at the other end of the fairway opposite the target area;

a ball collection trough located below the target area for collecting balls that are shot at the target area for return to the teeing area;

a shock absorbing depending curtain assembly in the target area for stopping balls directed toward the target area for deposit into said ball collecting trough, said curtain assembly having a plurality of openings;

a plurality of target units mounted in the target area behind said openings in said shock absorbing curtain assembly;

a putting hole located in the fairway opposite the teeing area;

means for sensing a ball that hits a target unit and balls that pass through said putting hole with each target having an assigned score value depending on its location;

a sweeping board attached to a wheel-mounted support frame movable on guide tracks along the fairway for sweeping dead balls from the fairway into said collection trough and movable from a first position wherein balls on the fairway are not contacted by movement of said sweeping board to a second position wherein balls on the fairway are contacted by movement of said sweeping board;

reversible drive means for moving said sweeping board across the fairway from the target area to the teeing area and from the teeing area back to the target area; and means for moving said sweeping board from said first position to said second position and from said second position to said first position.

14. A golf game as defined in claim 13 further comprising a ball return conduit coupled to said ball collection trough for returning balls by gravity to the teeing area.

15. A golf game as defined in claim 14 wherein each target unit has a through passage with an inlet opening for receiving balls and an outlet opening for discharging said balls.

16. A golf game as defined in claim 14 wherein said means for sensing comprises a photoelectric device in said outlet of each target unit connected to a scoreboard and a contact switch in the putting hole connected to the scoreboard whereby an assigned score is registered for balls that pass through said targets and said putting hole.

* * * * *